United States Patent [19]

Rognon

[11] 4,108,129

[45] Aug. 22, 1978

[54] SAFETY GROUP FOR DIESEL ENGINES

[76] Inventor: Armand Rognon, 22 rue Géo-Lufbéry, Chauny (Aisne), France

[21] Appl. No.: 743,912

[22] Filed: Nov. 22, 1976

[30] Foreign Application Priority Data

Dec. 1, 1975 [FR] France ..... 75 36721

[51] Int. Cl.[2] ..... F02B 77/08

[52] U.S. Cl. ..... 123/139 AZ; 123/196 S; 123/198 DB

[58] Field of Search .... 123/198 DB, 198 D, 198 DC, 123/139 AZ, 196 S

[56] References Cited

U.S. PATENT DOCUMENTS

| | | | |
|---|---|---|---|
| 2,551,429 | 5/1951 | Eppens | 123/198 DB X |
| 2,645,474 | 7/1953 | Barnes | 123/198 DB X |
| 3,791,366 | 2/1974 | MacMillan | 123/198 DB |
| 3,865,090 | 2/1975 | Masters et al. | 123/198 DB X |
| 3,905,348 | 9/1975 | Williams | 123/198 DB X |

*Primary Examiner*—Charles J. Myhre
*Assistant Examiner*—Ira S. Lazarus
*Attorney, Agent, or Firm*—Marmaduke A. Hobbs

[57] ABSTRACT

The invention relates to a safety group for diesel engines, comprising a safety shutoff device, an overspeed mechanism, and an oil pressure collapse mechanism, in which the axis of the plunger forcing the fuel rack to off position has a radially extending pin sliding with said plunger. This pin is arranged to actuate a member driving the combustive air inlet valves.

The safety group includes also an oil pressure piloting valve controlled by the circuit controlling the combustive air inlet valves.

8 Claims, 2 Drawing Figures

SAFETY GROUP FOR DIESEL ENGINES

Figure 1:
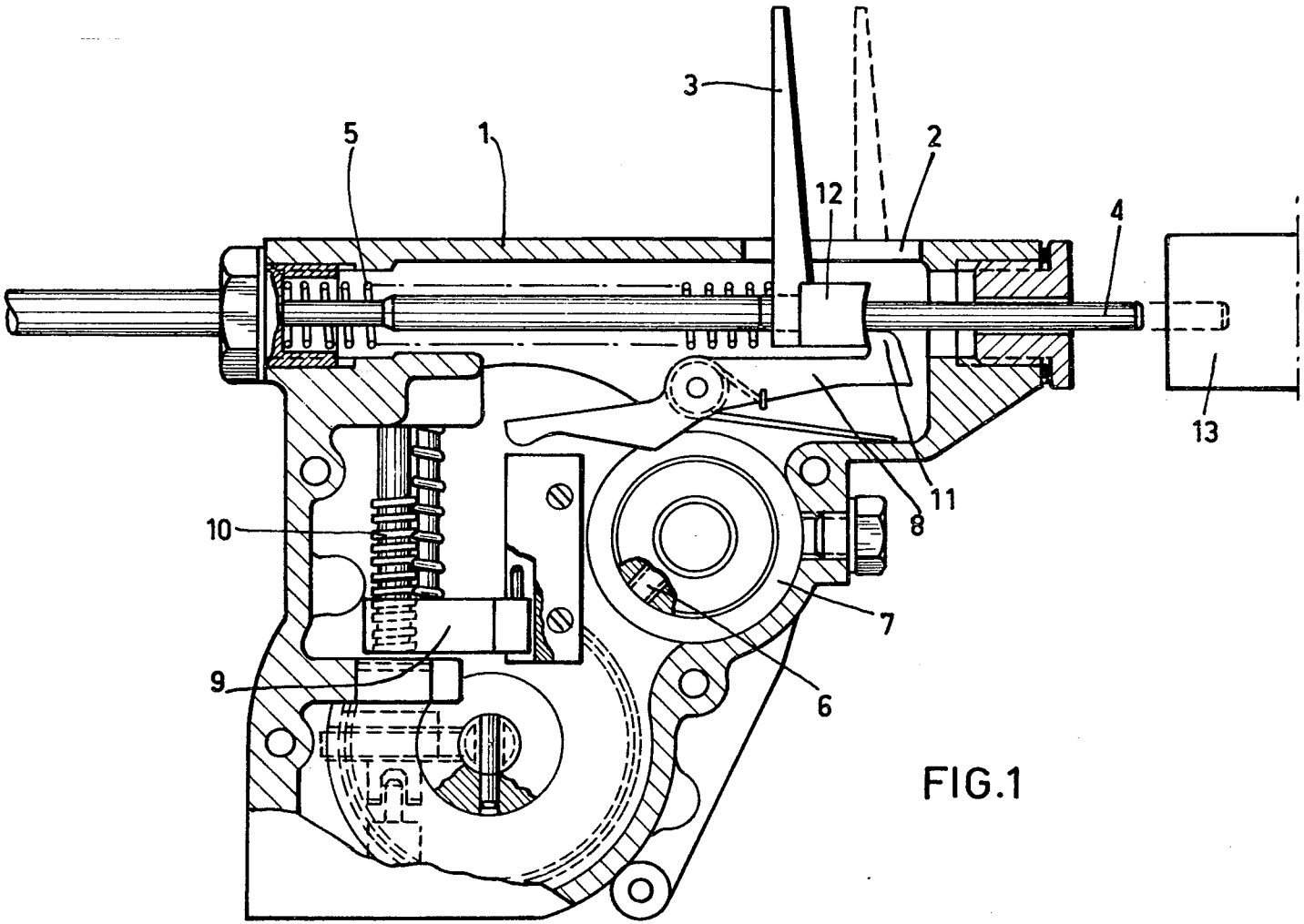

The present invention relates to a safety group for diesel engines installed in dangerous areas.

Some engines are provided with standard shutoff devices for protection against either overspeed or oil pressure drop, or also increase of temperature of the cooling water.

Such devices operate essentially, directly or indirectly, on the fuel injection pumps.

Such devices can also comprise an overspeed mechanism driven by the engine with an excentered flyweight which under the effect of a centrifugal force exceeding, beyond the speed limit, the strength of the flyweight biasing spring, moves towards the outside from its rest position in order to strike a trigger releasing a spring loaded plunger for forcing the fuel rack to opposition.

Moreover, an endless screw may also be driven by the engine; an oil pressure collapse below the normal operating minimum level releases a sliding member which engages the endless screw and slides along its axis until it strikes the aforesaid trigger, and causes the injection of the engine to be cut.

The overspeed mechanism and the oil pressure collapse mechanism are generally located inside the same emergency stop oleo-mechanical device, or shut-off, including also the trigger and the spring loaded plunger.

Protection of the engine against an increase of temperature of the cooling water may be secured by means of a thermostatic bulb which, if the temperature becomes too high, opens an escape valve which in turn causes a drop of oil pressure in the shut-off, and stops the injection of the engine.

When the rack of the injection pump of a diesel engine is set to off position, one should also be able to cut the admission of combustive air. The reason is that the air may contain combustive gases of calorific value even higher than that of the fuel, and stopping the injection may not be sufficient to stop the engine. In this case and beyond, for protection of the engine against eventual overspeed, the air inlet valves have to be closed. This safety is reached in standard fashion by means of a butterfly valve mounted in each intake manifold and actuated through a flexible cable by the aforesaid shut-off device.

The standard safety shutoff devices, and particularly the air inlet shutoff devices, offer unfortunately a reduced reliability and life time, and one of the objects of the present invention is to provide improvements thereto.

On standard engines, a reset button has to be pushed when the safety devices have operated, in order to reset the spring loaded plunger. But the resetting of the air inlet safety mechanism is not linked to the resetting of the fuel injection safety mechanism.

An object of the present invention is therefore, to link the resetting of the air inlet safety mechanism to the resetting of the fuel injection safety mechanism, so that the resetting of all the safety mechanisms are simultaneous.

Thus, the invention relates to a safety group for diesel engine, comprising a safety shutoff device with an overspeed mechanism driven by the engine which controls a trigger releasing a spring loaded plunger which sets the fuel rack of the engine injection pump to off position and with an oil pressure collapse mechanism actuating said trigger, said device being connected to an escape valve, controlled by at least one breakdown detector with upstream thereof an oil pressure identical to that prevailing inside the device, and controlling means arranged for actuating a member controlling the combustive air inlet valves, characterized in that the plunger axis is formed with a radial pin extending out of the casing of said device and sliding with said plunger, said pin being arranged for actuating the member controlling the combustive air inlet valves.

With this improvement, the stopping of the injection of the engine following an overspeed, an oil pressure collapse, or, for instance, an increase of the temperature of the cooling water, causes automatically the closing of the combustive air inlet valves; when the plunger is re-locked, and thereby brought back to its initial position against the strength of its biasing spring, this action causes the pin to come back into engagement, with the member controlling the air inlet valve, with the result that the air inlet mechanism is simultaneously also reset.

The member controlling the combustive air inlet valves may advantageously be a pneumatic distributor connected to an outside air source, and thereby distribute the pressure to jacks actuating the air inlet valves.

Preferably, the distributor is supplied through a non-return valve, in order to avoid a flux of air in the reverse direction which would unintentionally stop the engine, and through an air accumulator, in order to compensate the air losses which would close the air inlet valves.

In the same manner as a stop of the fuel injection should preferably urge a cut in the combustive air inlet, it is also interesting to be in a position to stop the fuel injection in the engine should the air inlet valves close. It is a further object of the present invention to improve in this direction the safety devices of diesel engines.

To this effect, the safety shutoff device may be connected to an oil pressure piloting valve located between the safety shutoff device and the escape valve on the oil supply circuit of said valve, its outlet being also connected to the engine casing and controlled by the circuit driving the air inlet valves, in such manner that, in normal use, the valve is open and the oil pressure in the safety shut-off device is kept at a normal level, and that, in the case of a cut of the air inlet, the valve is inverted in order to create, in the same manner as where there is an increase of temperature of the cooling water, an oil flow towards the engine casing causing a collapse of oil pressure in the shutoff device, thereby causing the fuel injection to stop.

Such an arrangement for diesel engine safety devices permits of course to install other detectors in parallel on the cooling water temperature detector or instead and downstream of the oil pressure piloting valve on the pressure release valve supply circuit, such for instance as an engine exhaust gas temperature detector, or an excess pressure valve in the casing.

Yet, it is also interesting to complete the safety group of diesel engines, and notably when they are provided with an excess of air, by avoiding a too rough closing of the air inlet valves when there is a stop of fuel injection which would create an over-pressure at the inlet of the air supercharger.

To this effect, the air inlet valves are connected to their driving member through a time-lag device.

Moreover, it is interesting to dispose of information means on how the engines run.

To this effect, and in order to gather the start-stop information, an indicator may be located as by pass on the circuit driving the air inlet valves and downstream of their control member.

The oil pressure piloting valve operates essentially when the engine is part of a whole installation. It is therefore desirable to be able to act in an isolated fashion on each engine as regards the inlet of combustive air.

To this effect, the present invention provides a manual control for the oil pressure piloting valve by providing on its control circuit a manual control device.

In the case where the driving member of the combustive air inlet valves is a pneumatic distributor, the manual control device is a valve located on the circuit of the outer air source, upstream of this pneumatic distributor, in order also to be able to cut the air inlet of the pneumatic distributor.

Figure 2:
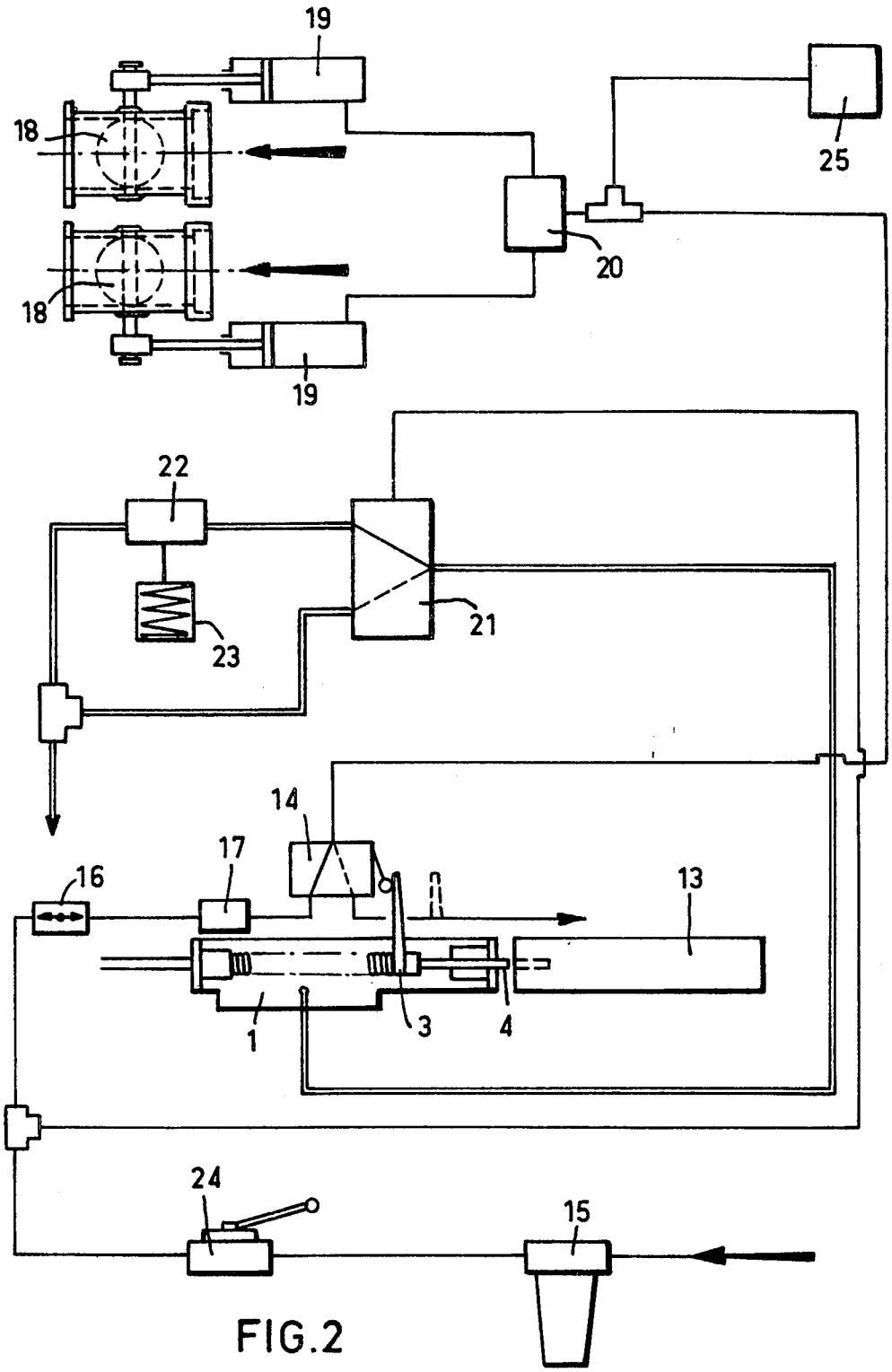

The invention will become more apparent from the following description of one embodiment of the device according to the invention in conjunction with the accompanying drawing where:

FIG. 1 represents an improved safety oleo-mechanical device according to the invention, and FIG. 2 represents the block-diagram of a safety group according to the invention.

FIG. 1 represents a safety oleo-mechanical shut-off device with a cast gearcase 1 where a mortise 2 has been machined for guiding rectilinearly a pin 3 radially secured to a plunger 4 biased by a spring 5 and integral with the rack of the injection pump 13 of the diesel engine. When the spring biased flyweight 6 of the overspeed mechanism 7 driven by the engine, under the action of a centrifugal force exceeding the strength of the biasing spring of the flyweight, strikes the trigger 8, or when the sliding member 9 engages an endless screw 10 and knocks said trigger 8 when there is a collapse of oil pressure below a pre-set level, the heel 11 of said trigger releases a looking flange 12 secured on plunger 4 and unlocks said plunger, thereby causing during its lateral movement and under the action of its spring 5, pin 3 to move. As the plunger is relocked, pin 3 is moved back to its initial position.

Reference is now made to FIG. 2, where the same references are used for the same elements as in FIG. 1.

Pin 3 operates a pneumatic distributor 14 connected to the outer air source 15 through a non return valve 16 and an air accumulator 17. The check valve 16 avoids a flow of air in the return direction which would unintentionally stop the engine, and the air accumulator is designed for compensating the air losses which would inadvertently close the air inlet valves 18 of the engine. The pneumatic distributor 14 distributes the pressure to jacks 19 actuating the air inlet valves 18 through a time-lag device 20, in order to avoid a rough closing of valves 18 which would create an overpressure at the inlet of the air supercharger of the diesel engine.

When plunger 4 sets the injection pump rack 13 to off position pin 3 is disengaged from distributor 14, which opens and connects the pneumatic circuit under its control with the open air and closes thereby valves 18 by the section of jacks 19.

Casing 1 of the oleo-mechanical device is connected through an oil circuit to the inlet of an oil pressure piloting valve 21 controlled by an outer air source 15 whose outlet is connected either to an end of the pressure release valve 22 controlled by at least one breakdown detector 23, as for instance the cooling water and exhaust gas temperature detectors, or directly to the casing of the diesel engine, the other end of valve 22 being also connected to the engine casing. When the engine air inlet valves 18 are closed, or when there is a break in the outer air source circuit, valve 21 closes and its outlet is then connected to the engine casing, creating thereby an oil pressure collapse in the oleo-mechanical device and causing the engine injection to stop. When the engine is running normally, valve 21 is open, and the oil pressure in casing 1 is kept at the level of that at the inlet of valve 22. When there is a breakdown detected by detector 23, valve 22 opens, creating thereby, while valve 21 is kept open, a collapse of oil pressure in the oleo-mechanical device and causing as previously the engine injection to stop.

A manual control valve 24, situated upstream of valve 21 and valve 16 on the outer air source circuit, permits to stop the engine individually when used amongst other equipment.

Finally, an indicator 25 positioned in by-pass on the control circuit of air inlet valves 18 supplies the start-stop information of the engine.

What I claim is:

1. In a diesel engine including a fuel pump, with a fuel pump rack-bar, air intake manifolds, each incorporating a throttle plate, means for actuating said throttle plates, and a power supply for said actuating means: a safety control system comprising a safety shut-down mechanism, means for controlling said throttle plate actuating means and connected to said power supply, an oil pressure release valve connected to said safety shut-down mechanism, an unsafe engine operating condition detecting means for controlling said release valve, said safety shut-down mechanism including a spring loaded piston engaging said rack-bar, a trigger engaging said piston, a governor driven by the engine and responsive to engine over-speeding, a sliding member responsive to failure in engine lubricating oil pressure, said governor and sliding member being capable of actuating said trigger for disengaging said trigger from said piston and thus releasing said piston, whereby said rack-bar engaged by said piston is urged, under the action of said spring, to idle position, a lever being fixedly secured to said piston and extending outwardly of said safety shut-down mechanism for actuating said controlling means.

2. A safety control system as claimed in claim 1, wherein said means controlling said actuating means is a pneumatic distributor connected to an outer air supply.

3. A safety control system as claimed in claim 2, wherein a non-return valve and an air accumulator connect said pneumatic distributor to said outer air supply.

4. A safety control system as claimed in claim 1, wherein said system includes an oil pressure controlling valve, and said safety shut-down mechanism is connected to the inlet of said oil pressure controlling valve, one outlet of which being connected to said release valve and another outlet of which being connected to the engine, said oil pressure controlling valve being controlled by said power supply connected to said controlling means for said means actuating said throttle plates.

5. A safety control system as claimed in claim 1, wherein said system includes a timer device, and said controlling means controls said actuating means through said timer device.

6. A safety control system as claimed in claim 4 wherein said system includes a pneumatic distributor, and said throttle plates have pneumatic actuating jacks, and said power supply is an outer air supply connected to said oil pressure controlling valve and to said pneumatic distributor for controlling said pneumatic jacks to actuate said throttle plates.

7. A safety control system as claimed in claim 6, wherein said system includes a timer device, and said pneumatic distributor controls said actuating jacks through said timer device.

8. A safety control system as claimed in claim 4, wherein said system includes a manually operable device, and said power supply is connected to said oil pressure controlling valve and to said controlling means through said manually operable device.

* * * * *